United States Patent [19]

Simpson

[11] 4,404,915

[45] Sep. 20, 1983

[54] PORTABLE DESK-WORK BENCH

[76] Inventor: Lewis H. Simpson, 101 Hilborn Ave., #18, Vallejo, Calif. 94590

[21] Appl. No.: 217,792

[22] Filed: Dec. 18, 1980

[51] Int. Cl.[3] ..... A47B 37/00

[52] U.S. Cl. ..... 108/43; 108/129

[58] Field of Search ..... 108/43, 121, 129; 190/11, 12 R; 248/444; 312/239, 231

[56] References Cited

U.S. PATENT DOCUMENTS

| | | | |
|---|---|---|---|
| 135,040 | 1/1873 | Mahan | 108/43 |
| 1,421,929 | 7/1922 | Floreskul | 190/12 R |
| 1,827,952 | 10/1931 | Noyes | 108/121 |
| 2,189,247 | 2/1940 | Johnson | 108/43 |
| 2,324,684 | 7/1943 | Dietz | 190/11 X |
| 2,808,191 | 10/1957 | Cramer | 108/43 X |
| 3,785,299 | 1/1974 | Caperton, Jr. | 312/231 |
| 3,923,356 | 12/1975 | Washburne | 190/11 |

FOREIGN PATENT DOCUMENTS

| | | | |
|---|---|---|---|
| 812680 | 9/1951 | Fed. Rep. of Germany | 108/43 |
| 4731 | of 1896 | United Kingdom | 108/43 |
| 278104 | 10/1927 | United Kingdom | 108/43 |

*Primary Examiner*—Francis K. Zugel

*Attorney, Agent, or Firm*—Harvey B. Jacobson

[57] ABSTRACT

A work surface defining assembly is provided for use by seated persons. The assembly includes a horizontal upper work surface and includes remote transverser front and rear marginal portions. Depending front legs are supported from the assembly adjacent the opposite end portions of the front transverse marginal portion and the rear marginal portion includes transversely spaced downwardly facing abutment surface portions for engagement with and support from the upwardly facing upper surfaces of the horizontal upper leg portions of a seated person. The assembly also defines a downwardly opening cavity and the front legs and the assembly include coacting structure for upward folding of the legs into retracted positions within the cavity. In a first form of the invention, the abutment surface portions are carried by opposite end portions of a horizontal transverse foot mounted on the lower end of a short depending center rear leg which is adjustable in length and also foldable upwardly into the cavity and a second form of the invention includes a short depending rear leg also foldable upwardly into the cavity, but provided independent of the downwardly facing upper leg engageable abutment surfaces.

2 Claims, 7 Drawing Figures

PORTABLE DESK-WORK BENCH

BACKGROUND OF THE INVENTION

Various forms of collapsible desk and work benches heretofore have been provided, but few, if any, have been specifically designed for use by a seated person. In addition, many of the previously known forms of foldable desk and/or work benches are too large and cumbersome to be utilized in restricted areas.

Accordingly, a need exists for a work bench or desk construction specifically designed to be utilized by seated persons and including structural features enabling the provision of a relatively small compact unit which may be used in restricted space areas.

Examples of previously known forms of foldable desk and/or work benches including some of the general structural and operational features of the instant invention are disclosed in U.S. Pat. Nos. 336,347, 873,855, 1,293,685, 1,445,566, 2,269,370, 2,406,237, 3,512,620 and 3,923,356.

BRIEF DESCRIPTION OF THE INVENTION

The portable desk-work bench of the instant invention includes a pair of upwardly foldable dependingly supported opposite side front legs and a central upwardly foldable rear depending leg. In one form of the invention, the rear depending leg is adapted for engagement with the front marginal edge portion of a seat upon which the user of the desk or work bench is seated and in a second form of the invention, the lower end of the short rear leg includes a transversely enlarged foot whose opposite end portions define arcuate lengthwise extending and downwardly opening arcuate abutment surface portions for engagement with the upper surface of the horizontal upper leg portions of the user of the desk or work bench. The desk or work bench defines a downwardly opening cavity into which the front and rear legs are upwardly foldable and the desk or work bench includes structure defining a rearwardly opening drawer cavity and includes a drawer slidably mounted within the cavity and rearwardly extendible toward an open position for access thereinto from above.

The main object of this invention is to provide a compact desk, work bench construction specifically designed to be utilized by seated persons.

Another object of this invention is to provide an apparatus in accordance with the preceding object and including a pair of long opposite side front depending legs for engagement with the floor and a short rear central leg.

Yet another object of this invention is to provide a construction in accordance with the preceding objects and wherein the front and rear legs may be upwardly folded into a downwardly opening central cavity defined by the desk or work bench.

Another important object of this invention is to provide a combined desk and/or work bench which may be utilized by a seated person and with the desk or work bench occupying a plan area only slightly larger than the plan area occupied by the horizontal upper leg portions of a seated person.

A final object of this invention to be specifically enumerated herein is to provide a portable desk-work bench construction in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
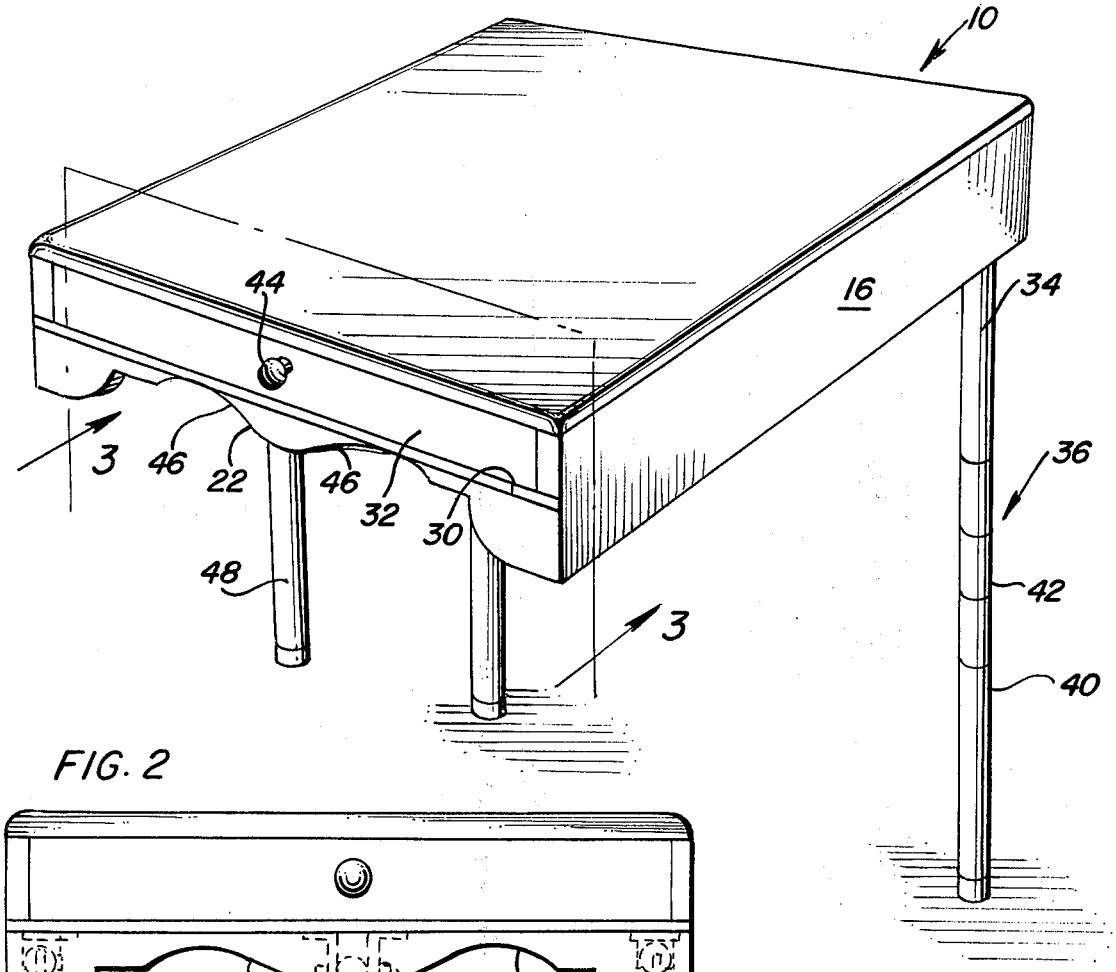
FIG. 1 is a perspective view of a first form of the desk-work bench of the instant invention with the legs thereof in a dependingly extended position.

Referring now more specifically to the drawings, the numeral 10 generally designates an assembly defining a combined desk and work bench. The assembly 10 includes an upper generally horizontal rectangular panel 12 whose upper surface 14 defines a work surface.

The assembly 10 additionally includes opposite side peripheral walls 16 and 18 and front and rear peripheral walls 20 and 22. The peripheral walls 16, 18, 20 and 22 extend about and depend downwardly from the marginal portions of the panel 12 and define a downwardly opening cavity 24 between the lower marginal portions thereof. In addition, the assembly 10 includes a horizontal baffle 26 extending between the peripheral walls a spaced distance below the panel 12 with the baffle 26 defining the upward extremity of the cavity 24 and a void or recess 28 beneath the panel 12 and above the baffle 26. The rear wall 24 has an opening 30 formed therein opening into the recess 28 and a horizontally slidable drawer 32 is slidably disposed within the recess 28 for front to rear shifting between closed and open positions.

The forward opposite side corners of the assembly 10 supports the upper end portions 34 of a pair of depending long legs referred to in general by the reference numerals 36 therefrom. The upper end portions 34 are pivotally supported within the opposite side portions of the cavity 24 as at 38 for swinging between operative positions and upwardly swung generally horizontal inoperative positions received within the cavity and each of the long legs 36 includes a lower end portion 40 and a central portion 42 disposed between the corresponding upper and lower end portions 34 and 40 and to which the portions 34 and 40 are pivotally connected for relative swinging. Thus, each of the legs 36 may be upwardly swung to a retracted position disposed in the corresponding side of the downwardly opening cavity 24.

The drawer 32 includes a pull knob 44 and the lower marginal edge of the rear wall 22 includes a plurality of longitudinally spaced and extending downwardly opening arcuate abutment surfaces 46 spaced apart longitudinally of the rear wall 22.

In addition, a short rear leg 48 is provided and is pivotally mounted as at 50 within the cavity 24 and is swingable from a downwardly projecting operative position upwardly into a horizontal retracted position received within the cavity 24. It will be noted that the abutment surfaces 46 are disposed on opposite sides of a vertical front to rear extending plane containing the rear short leg 48 and that the front long legs 36 are disposed on remote sides of front to rear extending vertical planes containing the remote end portions of the abutment surfaces 46.

Figure 2:
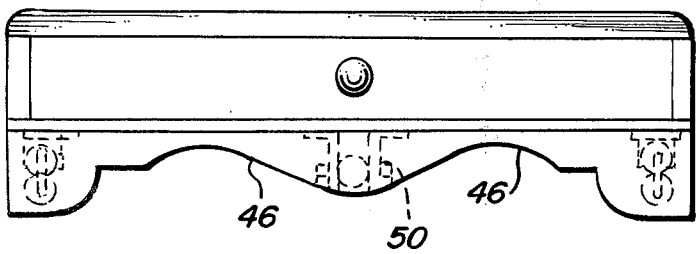
FIG. 2 is a front elevational view of the apparatus with the legs in upwardly folded positions.
Figure 3:
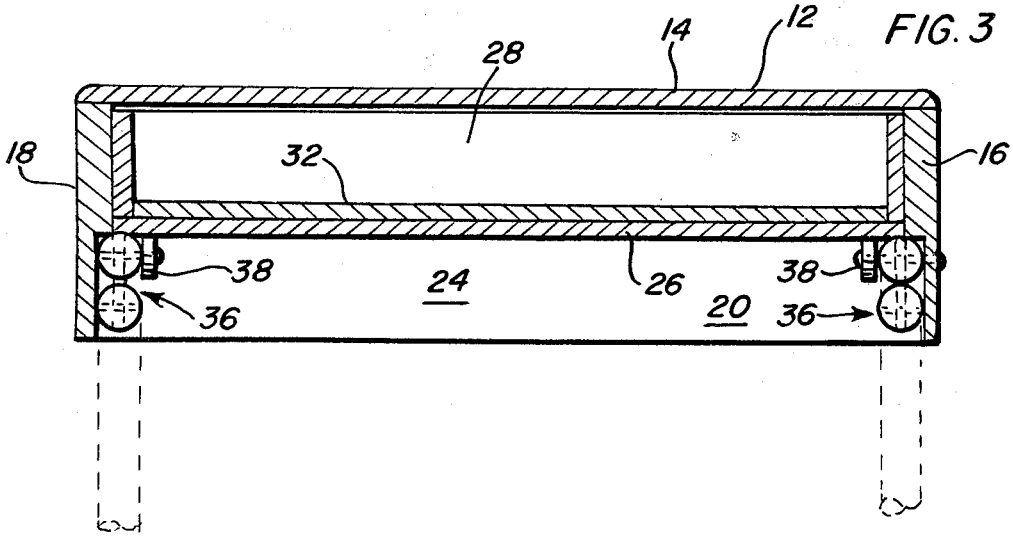
FIG. 3 is an enlarged vertical sectional view taken substantially upon the plane indicated by the section line 3—3 of FIG. 1.
Figure 4:
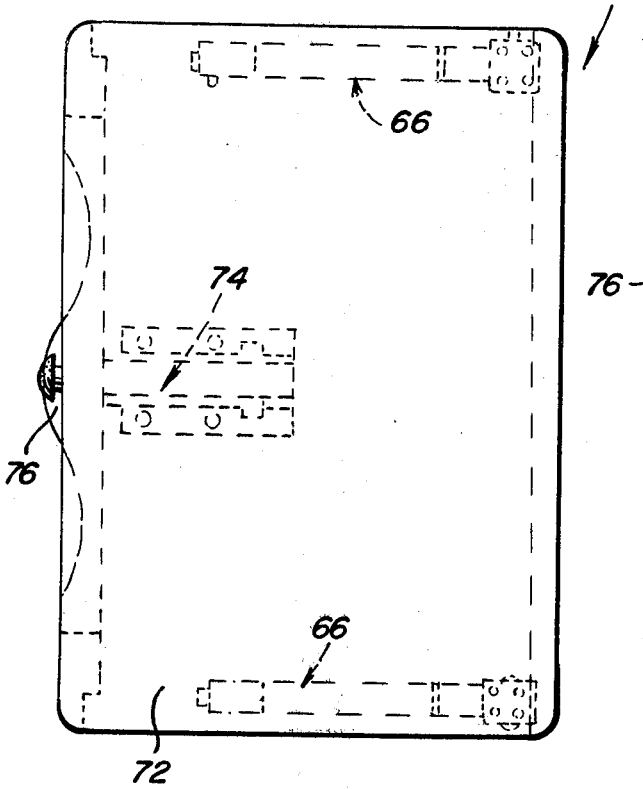
FIG. 4 is a top plan view of a second form of the invention with the legs thereof in a folded condition.
Figure 5:
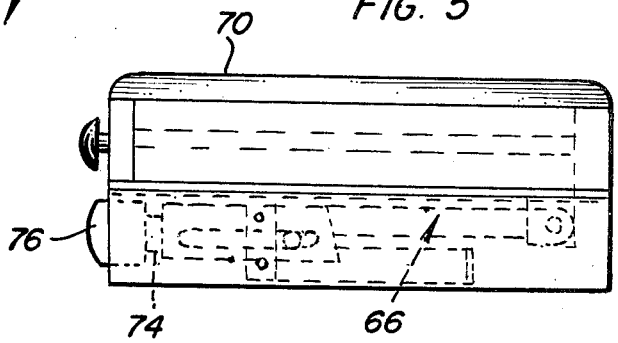
FIG. 5 is a side elevational view of the assemblage illustrated in FIG. 4.
Figure 6:
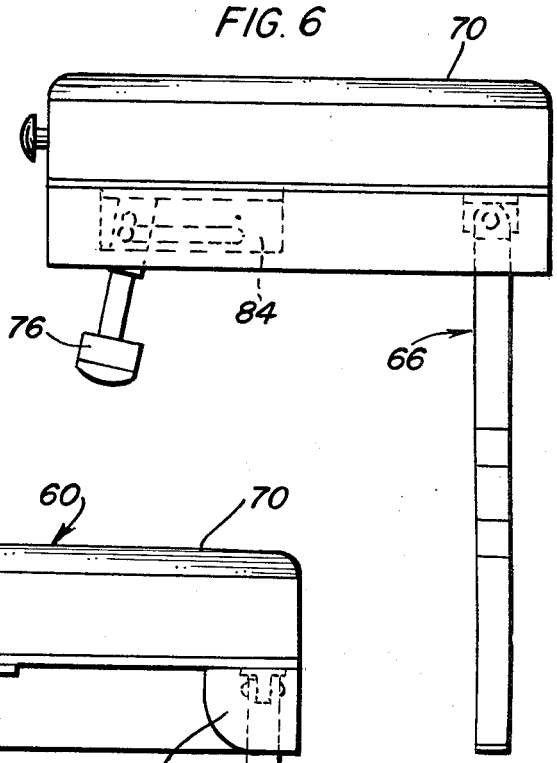
FIG. 6 is a side elevational view similar to FIG. 5, but with the legs of the second form in depending operative positions.
Figure 7:
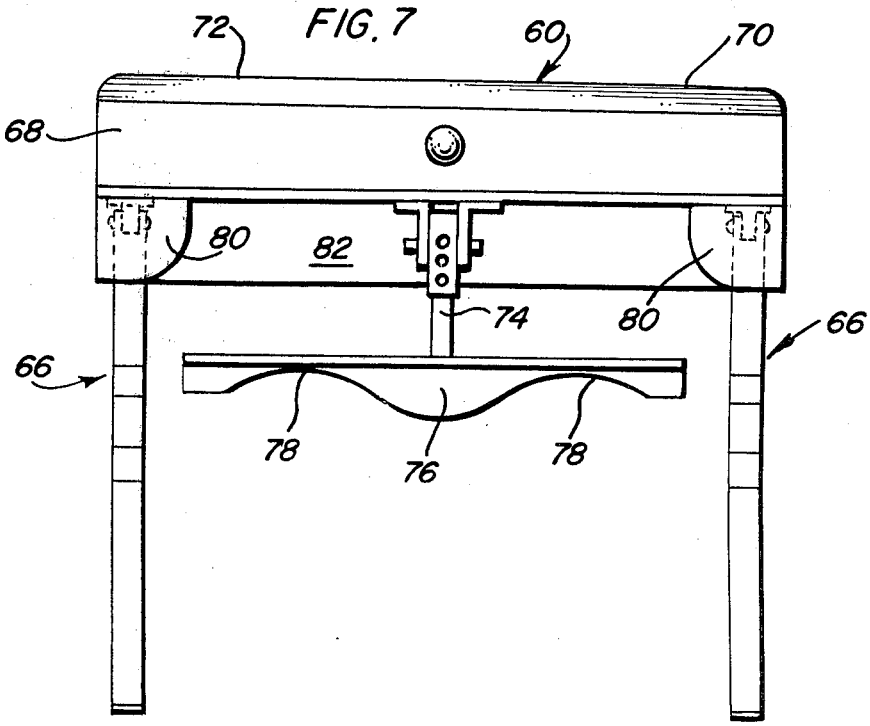
FIG. 7 is an elevational view of the assemblage illustrated in FIG. 7 as seen from the left side of FIG. 6.

In operation, the assembly 10 may be provided with any suitable form of handle for carrying in the manner of a briefcase or a piece of luggage. When it is desired to utilize the assembly 10, the long legs 36 are unfolded and disposed in the positions thereof illustrated in FIG. 1 and the short rear leg 48 is swung downwardly into the position illustrated in FIG. 1. Then, a person wishing to use the assembly 10 may be seated on a conventional chair or other similar seat with the long legs 36 engaged with the floor upon which the chair or seat is supported, the downwardly opening abutment surfaces 46 engaged with and supported from the upper surfaces of the horizontal upper leg portions of the user and the lower end of the short leg 48 downwardly abutted against the upper surface of the seat upon which the user is seated. In this manner, the assembly 10 is supported in a steady manner for use or the upper surface 14 either as a work bench of a desk top. Of course, when not in use, the legs 36 as well as the leg 48 may be swung upwardly to the horizontal retracted positions thereof illustrated in FIG. 2.

With attention now invited more specifically to FIGS. 4 through 7 of the drawings, there may be seen a second form of assembly constructed in accordance with the present invention and generally referred to by the reference numeral 60. The structure 60 is similar in many respects to the assembly 10 in that it includes upwardly foldable and retractable long front legs 66 corresponding to the legs 36, a drawer 68 corresponding to the drawer 32 and an upper panel 70 corresponding to the panel 12 and including an upper work surface 72. However, the assembly 60 differs from the assembly 10 in that the short rear leg 74 of the assembly 60 corresponding to the leg 48 is adjustable in length. Further, the lower end of the leg 74 includes a transverse horizontal foot 76 upon which downwardly opening abutment surfaces 78 corresponding to the abutment surfaces 46 are formed. The foot 76, when the leg 74 is in the upwardly swung retracted position, defines a central portion of the front wall of the assembly 10, the assembly 10 otherwise including only a pair of opposite end stationary front wall sections 80 between which the foot 76 is received when the leg 74 is swung upwardly to the retracted position thereof.

The assembly 60 defines a cavity 82 into which the legs 66 and 68 are upwardly swingable toward retracted positions.

In pivotally supporting the short leg 74 from the rear marginal portion of assembly 60 within the cavity 82, the upper end of the short leg 74 includes a transverse spring bias pin shiftably supported from the short leg 74 for slight shifting longitudinally thereof. In order to swing the short leg 74 from the operative position thereof illustrated in FIG. 6, the short leg 74 is grasped, pulled downwardly, shifted forwardly relative to the opposite side slotted brackets 84 and then swung rearwardly and upwardly to the retracted position thereof illustrated in FIG. 5.

When utilizing the assembly 60, the leg 74 thereof is not quite as long as the short leg 48 of the assembly 10 and merely engages the upper surfaces of the horizontal upper leg portions of the seated user of the structure 60.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A work surface defining horizontal assembly for use by seated persons, said assembly including a horizontal upper surface defining a work surface, said assembly including remote transverse front and rear marginal portions, depending front legs supported from said assembly adjacent the opposite end portions of said front transverse marginal portion, the rear marginal portion of said assembly including transversely spaced downwardly facing abutment surface portions for engagement with and support from the upwardly facing upper surfaces of the horizontal upper leg portions of a seated person, said assembly defining a downwardly opening cavity, said legs and assembly including coacting means for upward folding of said legs into retracted positions within said cavity, said assembly including a rear leg dependingly supported from the central portion of the rear marginal portion of said assembly, said rear leg being considerably shorter than said front legs and disposed in a front to rear extending vertical plane disposed between said abutment surface portions, the lower end of said rear leg being shaped to abut and be supported from the central forward marginal portion of a seat upon which the user of said assembly is seated with said rear leg being downwardly received between the upper leg portions of the user, said rear leg and assembly including coacting means for upward folding of said rear leg into retracted position within said cavity, said rear leg and said front legs being foldable upwardly into front to rear extending positions within said cavity, said abutment surfaces being arcuate, extending longitudinally of said rear marginal portion and opening downwardly, said front legs, when folded, being disposed outwardly of remote sides of vertical front to rear extending planes containing the remote end portions of said arcuate abutment surface portions and said rear leg being disposed in a front to rear extending vertical plane spaced between the adjacent ends of said arcuate abutment surfaces.

2. The combination of claim 1 wherein said assembly includes a rearwardly opening central drawer cavity and a horizontally shiftable drawer mounted within said drawer cavity for shifting between a forward position received within said downwardly opening cavity and a rearwardly displaced position projecting rearwardly from said rear marginal portion providing access to the interior of said drawer from above.

* * * * *